US009685692B2

(12) United States Patent
Hsu

(10) Patent No.: US 9,685,692 B2
(45) Date of Patent: Jun. 20, 2017

(54) ANTENNA STRUCTURE

(71) Applicant: Chi Mei Communication Systems, Inc., New Taipei (TW)

(72) Inventor: Cho-Kang Hsu, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 87 days.

(21) Appl. No.: 13/930,284

(22) Filed: Jun. 28, 2013

(65) Prior Publication Data

US 2014/0292583 A1 Oct. 2, 2014

(30) Foreign Application Priority Data

Mar. 27, 2013 (TW) ..... 102110826 A

(51) Int. Cl.

| | |
|---|---|
| ***H01Q 5/35*** | (2015.01) |
| ***H01Q 1/24*** | (2006.01) |
| ***H01Q 13/10*** | (2006.01) |
| ***H01Q 13/16*** | (2006.01) |

(52) U.S. Cl.

CPC ..... *H01Q 1/243* (2013.01); *H01Q 5/35* (2015.01); *H01Q 13/10* (2013.01); *H01Q 13/16* (2013.01)

(58) Field of Classification Search

CPC ..... H01Q 1/38
USPC ..... 343/700 MS, 702
See application file for complete search history.

(56) References Cited

U.S. PATENT DOCUMENTS

| | | | | |
|---|---|---|---|---|
| 6,850,192 | B2 * | 2/2005 | Yeh | H01Q 1/38 343/700 MS |
| 2002/0186169 | A1 * | 12/2002 | Iwai | H01Q 9/0414 343/702 |
| 2010/0060526 | A1 * | 3/2010 | Cheng | H01Q 1/38 343/700 MS |
| 2010/0328165 | A1 * | 12/2010 | Hsu | H01Q 9/26 343/702 |
| 2011/0309985 | A1 * | 12/2011 | He | H01Q 1/38 343/700 MS |
| 2012/0046002 | A1 * | 2/2012 | Hill | H01Q 1/243 455/73 |

* cited by examiner

*Primary Examiner* — Dameon E Levi
*Assistant Examiner* — Walter Davis
(74) *Attorney, Agent, or Firm* — Steven Reiss

(57) ABSTRACT

An antenna structure is configured to transmit and receive signal for a wireless communication device. The antenna structure includes a base board, a radiating unit, and a feed unit. The radiating unit and the feed unit are formed on the base board. The feed unit partially overlaps on the radiating unit to form a number of signal feed paths.

13 Claims, 2 Drawing Sheets

ANTENNA STRUCTURE

BACKGROUND

1. Technical Field

The disclosure generally relates to antenna structures, and particularly to an antenna structure having a broad working frequency band.

2. Description of Related Art

Antennas are important components of portable wireless communication devices such as mobile phones and personal digital assistants (PDAs) used for transmitting and receiving signals.

To ensure that the portable wireless communication device can communicate with other devices in wireless communication systems having different working frequencies, the antenna needs a broad working frequency.

Additionally, antennas having broad working frequency tend to occupy a large space in the wireless communication device, which may hinder the miniaturization of the wireless communication device.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
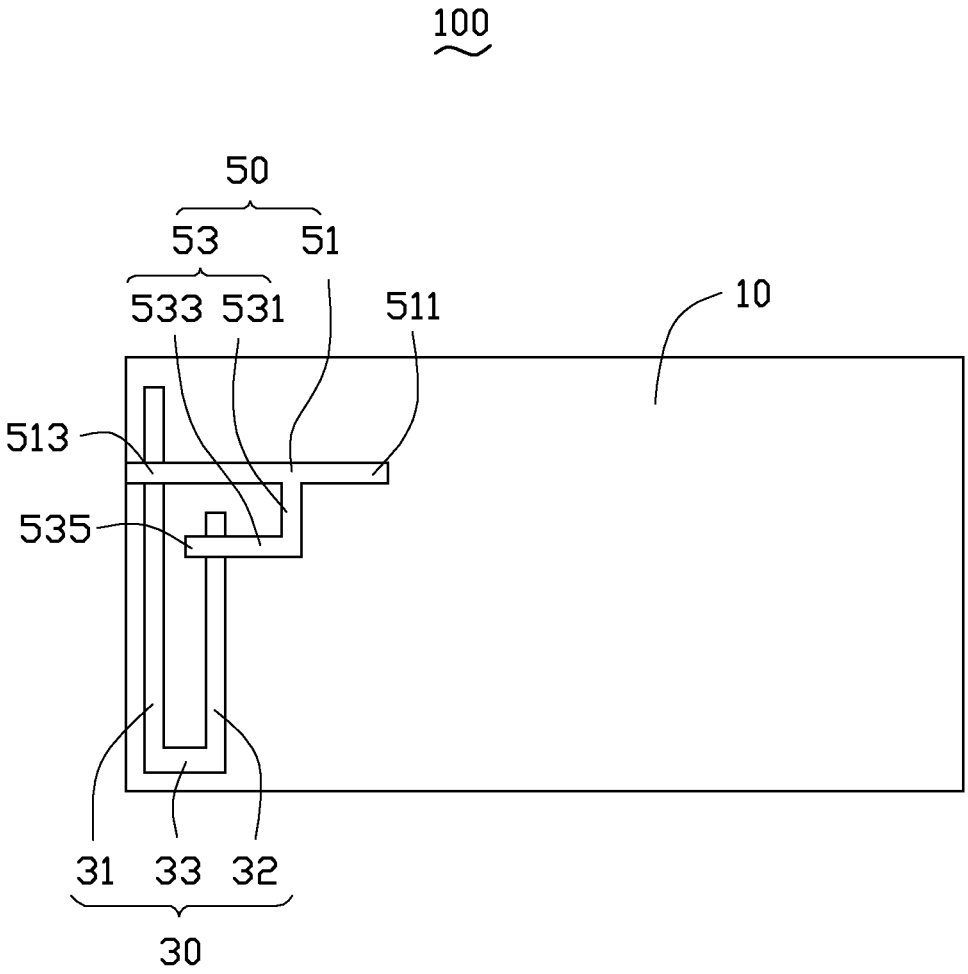
FIG. 1 is a schematic view of an antenna structure, according to an exemplary embodiment of the disclosure.

FIG. 1 is a schematic view of an antenna structure 100, according to an exemplary embodiment of the disclosure. The antenna structure 100 is used in a wireless communication device (not shown) such as a mobile phone, a tablet personal computer, etc. to transmit and receive signals.

The antenna structure 100 includes a base board 10, a radiating unit 30, and a feed unit 50. The radiating unit 30 and the feed unit 50 are formed on the base board 10. The feed unit 50 is partially overlapped on the radiating portion 30.

The base board 10 is a part of a housing of the wireless communication device. In this embodiment, the base board 10 is made of metal. The radiating unit 30 and the feed unit 50 are directly formed on the base board 10 to reduce cost of the antenna structure 100 and also make the entire antenna structure 100 occupy relative smaller space in the wireless communication device.

The radiating unit 30 is a slot antenna and is substantially U-shaped. The radiating unit 30 includes a first radiating section 31, a second radiating section 32 and a connecting section 33. The first radiating section 31, the second radiating section 32 and the connecting section 33 are strip-shaped. A length of the second radiating section 32 is slightly shorter than the first radiating section 31. The first radiating section 31 is spaced from and parallel to the second radiating section 32. One end of the first radiating section 31 is aligned with that of the second radiating section 32. The connecting section 33 is connected to the two aligned ends of the first and second radiating sections 31, 32 to form the U-shaped radiating unit 30.

The feed unit 50 is configured to connect to a signal feed point (not shown) of a circuit board of the wireless communication device and provide signal to the radiating unit 30.

In this exemplary embodiment, the feed unit 50 includes a main section 51 and a branch section 53 extended from the main section 51. The main section 51 is substantially strip-shaped and includes a feed end 511 and a first overlapping end 513 positioned at two opposite ends of the main section 51, respectively. The feed end 511 is for feeding the signal. The first overlapping end 513 overlaps the radiating unit 30. The branch section 53 is substantially L-shaped and includes a first bent section 531 and a second bent section 533 connected perpendicularly to the first bent section 531. The first bent section 531 is extended from one side of the main section 51. The second bent section 533 is formed by perpendicularly bending one end of the first bent section 531 opposite to the main section 51, and then extending a distance along a direction parallel to the main section 51. A second overlapping end 535 is formed by one end of the second bent section 533 away from the first bent section 531.

The feed unit 50 is positioned on the radiating unit 30. The main section 51 and the second bent section 533 are perpendicularly overlapped on the first radiating section 31 and the second radiating section 33, respectively. Thus, the main section 51 forms a first signal feed path with the first radiating section 31, and the branch section 53 forms a second signal feed path and the second radiating section 32.

Figure 2:
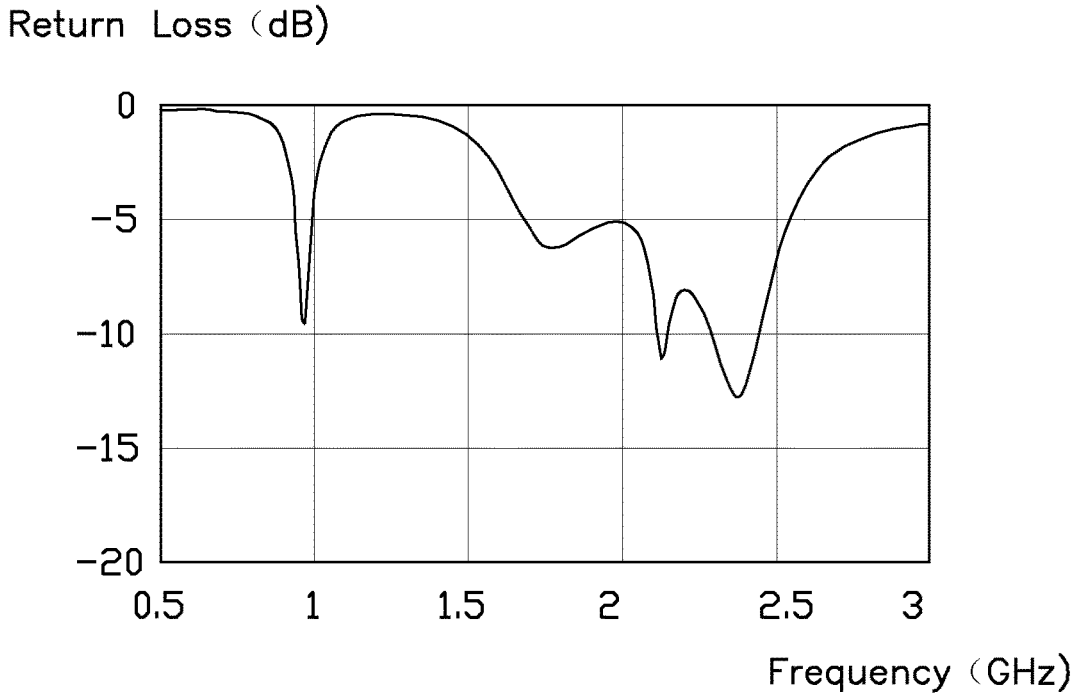
FIG. 2 is a diagram showing return loss (RL) measurement of the antenna structure shown in FIG. 1.

Referring to FIG. 2, in the embodiment, the antenna structure 100 obtains a low working frequency band which can reach 100 MHz and covers one of the GSM 850 frequency band and the GSM 900 frequency band and a high working frequency band which can reach to 860 MHz and covers DCS/PCS/UMTS2100/LTE2300/LTE2500 frequency band. Therefore, the working frequency band of radiating unit 30 can be broadened because of the multiple signal paths. In addition, the radiating unit 30 and the feed unit 50 are directly formed on the base board 10 to reduce cost of the antenna structure 100 and also allowing the entire antenna structure 100 to occupy relative smaller space in the wireless communication device.

In other exemplary embodiment, when a number of the radiating sections such as the first and second radiating sections 31, 32 of the radiating unit 30 is increased, a number of the branch sections 53 can be increased correspondingly to form the multiple signal feed paths.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna structure configured to transmit and receive signal for a wireless communication device, the antenna structure comprising:

a base board;

a radiating unit comprising a radiating section, a second radiating section and a connecting section, the first radiating section spaced from and parallel to the second radiating section, one end of the first radiating section aligned with one end of the second radiating section, the connecting section connected to the two aligned ends of the first and second radiating sections; and a feed unit, the feed unit comprising:

a main section; and a branch section coplanar with the main section and extending from the main section, the branch section being L-shaped and comprising a first bent section and a second bent section perpendicularly connected to the first bent section, the first bent section perpendicularly connected to the main section to corporately form a T-shape;

wherein the radiating unit and the feed unit are formed on of the base board, the feed unit partially overlaps the first radiating section to form a plurality of signal feed paths, the main section and the second bent section are perpendicularly overlapped on the first radiating section and the second radiating section, respectively; the main section and the second bent section pass through the first radiating section and the second radiating section, respectively to form two overlapping crisscross structures, an end of the second radiating section passes through the second bent section and is located between the main section and the second bent section, an end of the second bent section passes through the second radiating section and is located between the first radiating section and the second radiating section.

2. The antenna structure of claim 1, wherein the main section and the branch section overlaps the first radiating section and the second radiating section, respectively to form the signal feed paths.

3. The antenna structure of claim 2, wherein the main section comprises a feed end configured to feed signals and a first overlapping end respectively positioned at two opposite ends of the main section, the first overlapping end overlaps the first radiating section.

4. The antenna structure of claim 2, wherein the first bent section is extended from one side of the main section, the second bent section is formed by perpendicularly bending one end of the first bent section opposite to the main section, and then extending a distance along a direction parallel to the main section.

5. The antenna structure of claim 4, wherein the second bent section comprises a second overlapping end at one end of the second bent section away from the first bent section, the second overlapping end overlaps the second radiating section.

6. The antenna structure of claim 1, wherein the base board is a metal outer cover of the wireless communication device.

7. An antenna structure configured to transmit and receive signal for a wireless communication device, the antenna structure comprising:

a base board;

a radiating unit comprising a radiating section, a second radiating section and a connecting section, the first radiating section spaced from and parallel to the second radiating section, one end of the first radiating section aligned with one end of the second radiating section, the connecting section connected to the two aligned ends of the first and second radiating sections; and a feed unit, the radiating unit and the feed unit formed on the base board, the feed unit comprising a main section and a branch section coplanar with the main section and extending from the main section, the branch section being L-shaped and comprising a first bent section and a second bent section perpendicularly connected to the first bent section, the first bent section perpendicularly connected to the main section to corporately form a T-shape, the main section and the second bent section of the branch section perpendicularly overlap the first radiating section and the second radiating section to form a first signal feed path and a second signal feed path, respectively;

wherein the main section and the second bent section pass through the first radiating section and the second radiating section, respectively to form two overlapping crisscross structures, an end of the second radiating section passes through the second bent section and is located between the main section and the second bent section, an end of the second bent section passes through the second radiating section and is located between the first radiating section and the second radiating section.

8. The antenna structure of claim 7, wherein the main section comprises a feed end configured to feed signals and a first overlapping end positioned at two opposite ends of the main section, the first overlapping end overlaps the first radiating section.

9. The antenna structure of claim 7, wherein the first bent section is extended from one side of the main section, the second bent section is formed by perpendicularly bending one end of the first bent section opposite to the main section, and then extending a distance along a direction parallel to the main section.

10. The antenna structure of claim 9, wherein the second bent section comprises a second overlapping end at one end of the second bent section opposite to the first bent section, the second overlapping end overlaps the second radiating section.

11. The antenna structure of claim 7, wherein the base board is a metal outer cover of the wireless communication device.

12. The antenna structure of claim 1, wherein the feed unit and the radiating unit cooperatively define a substantially L-shaped slot therebetween.

13. The antenna structure of claim 7, wherein the feed unit and the radiating unit cooperatively define a substantially L-shaped slot therebetween.

* * * * *